US005806782A

United States Patent [19]

Teng

[11] Patent Number: 5,806,782

[45] Date of Patent: Sep. 15, 1998

[54] DOUBLE TRACK WIRE ARRANGING DEVICE FOR WINDING MACHINES

[75] Inventor: Kui-Yu Teng, Chung Ho, Taiwan

[73] Assignee: U Gear Automatic Machinery Co., Ltd., Taipei Hsien, Taiwan

[21] Appl. No.: 874,142

[22] Filed: Jun. 13, 1997

[51] Int. Cl.[6] ..... B65H 54/28; B65H 67/044

[52] U.S. Cl. ..... 242/482.7; 242/474.4

[58] Field of Search ..... 242/25 A, 18 A, 242/43 R, 158 R, 158.3

[56] References Cited

U.S. PATENT DOCUMENTS

| | | | |
|---|---|---|---|
| 1,659,127 | 2/1928 | Zindel | 242/43 |
| 2,409,942 | 10/1946 | Knapp | 242/158.3 X |
| 3,768,751 | 10/1973 | Brown | 242/25 A X |
| 3,837,589 | 9/1974 | Johnson et al. | 242/25 A |
| 3,963,186 | 6/1976 | Van Den Aa | 242/158 R X |
| 4,098,467 | 7/1978 | Engmann et al. | 242/25 A |
| 4,266,734 | 5/1981 | Baasch | 242/43 R X |
| 4,637,564 | 1/1987 | Hallenbeck et al. | 242/25 A |
| 5,676,324 | 10/1997 | Miyagawa | 242/158.3 X |

*Primary Examiner*—Michael Mansen
*Attorney, Agent, or Firm*—Bacon & Thomas

[57] ABSTRACT

A double track type wire arranging device for winding machines including a transmission device, a winding device, a direction change device, a reciprocating device, a support device, and a driven device. When the transmission device is started, it may respectively actuate the winding device and the direction change device. The direction change device in turn rotates a rotary wheel of the reciprocating device, forcing slide posts below the rotary wheel to displace back and forth in curved slide grooves, so that a swing rod connected to a lower portion of the reciprocating device swings through a sector with the support device as pivot. The action of the swing rod causes the driven device at one side of the reciprocating device to displace through a larger sector, so that wire arranging wheels at an outer end of the driven device reciprocate to wind wire on a winding disk shaft in an alternate manner.

5 Claims, 7 Drawing Sheets

DOUBLE TRACK WIRE ARRANGING DEVICE FOR WINDING MACHINES

BACKGROUND OF THE INVENTION (a) Field of the Invention

The present invention relates generally to a winding machine, and more particularly to a double track type wire arranging device for winding machines whereby wires may be wound in an alternate manner to reduce entanglement of the wires.

(b) Description of the Prior Art

Before delivery from the factory, wires are generally wound into a bundle with a hollow in the center to facilitate carrying and transportation. As a general rule, wire are wound on a winding machine.

A conventional winding machine essentially comprises an output shaft of a motor connected to a speed reducer via a belt. The speed reducer is in turn connected to one or more winding spindles via a pulley. When the motor rotates, the winding spindles will synchronously rotate. The winding spindles are respectively connected to a winding disk shaft, so that the entire length of the wire may, due to the extension or withdrawal of retractable screw rods at the upper end of the winding disk shafts, may wind orderly on the wind disk shafts. When the wire touches both sides of the winding disk, the retractable screw rod will change the direction of displacement. The cycle is repeated to obtain circular bundles of wire in an orderly manner.

To use the bundle of wound wire, the user may simply pass a shaft through the hollow in the center of the bundle and take out a lead end of the wire and then draw out the wire in order. However, for wires used in high precision industries, entire bundles of wires are stored in cartons to prevent from dust accumulation. In general, the bundle of wire is placed into a carton with the lead end passing through a hole formed in the carton. In use, the user just pulls the lead end and draw out the rest of the wire. However, since the inner layers of wire are tightly and compactly wound, the wire may get entangled when being pulled out, so that the user has to open the carton and disentangle the wire. This is not only inconvenient in use, the wire in the carton may be contaminated also.

Manufactures have attempted to wind wires or cables in an alternate manner to form bundles. However, how to make use of conventional retractable screw rods to achieve alternate winding and how to employ simple means to achieve this object is a problem needing to be solved.

SUMMARY OF THE INVENTION

A primary object of the present invention is to provide a double track type wire arranging device for winding machines, which enables wires to be wound on winding disk shafts in an alternate manner so as to prevent entanglement of wires during wire pulling.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
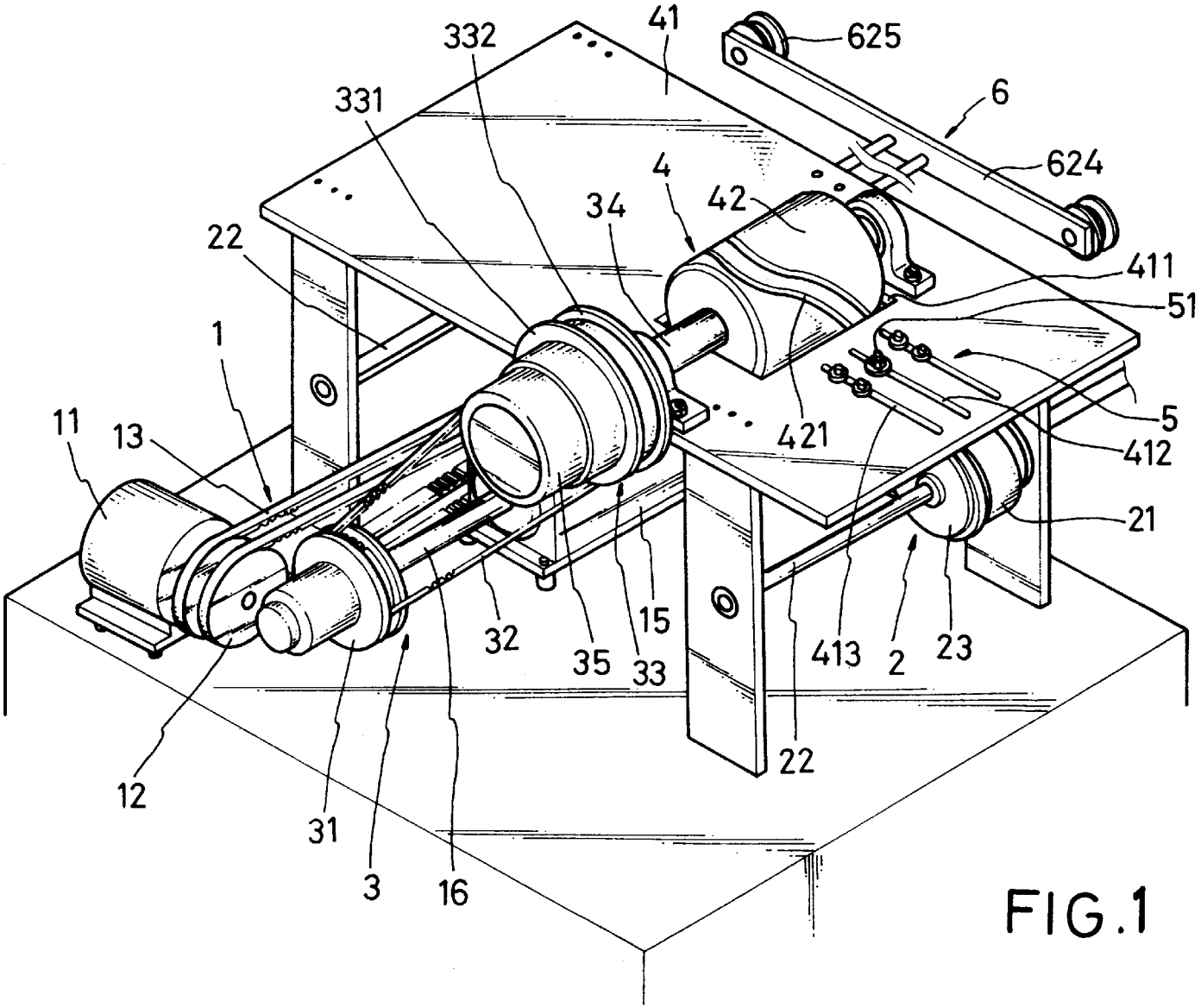
FIG. 1 is a schematic elevational view of the present invention.

As shown in the drawings, the present invention essentially comprises a transmission device 1, a winding device 2, a direction change device 3, a reciprocating device 4, a support device 5, and a driven device 6.

Figure 2:
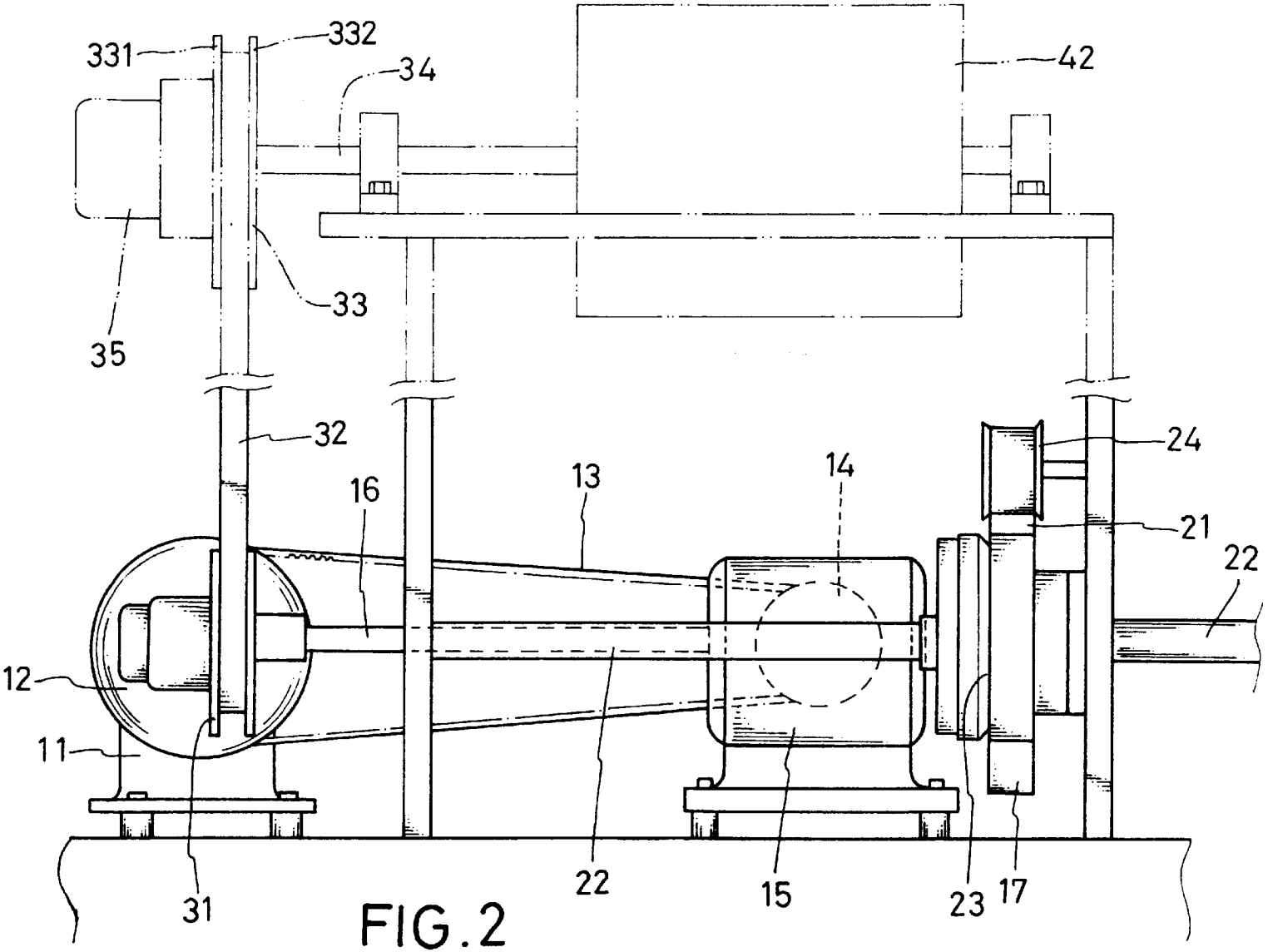
FIG. 2 is a side view of a transmission device of the present invention.

Referring to FIGS. 1 and 2, the transmission device 1 includes a motor 11 having an output shaft connected to an output wheel 12. The output wheel 12 in turn engages one or more output belts 13. The latter is further pivotally connected to a speed reducing wheel 14 (shown by dotted lines in FIG. 2). The speed reducer wheel 14 is further connected to a speed reducer 15 which is axially provided with a speed reducing shaft 16. One end of the speed reducing shaft 16 is coupled to a speed reducing gear 17 for rotating the winding device 2. The other end thereof is pivotally connected to the direction change device 3 to synchronously rotate the latter therewith. When the motor 11 is started, and the speed is reduced by the speed reducer 15, the winding device 2 and the direction change device 3 are brought to synchronously rotate therewith for transmission purposes.

The winding device 2 essentially comprises a toothed belt 21 engaging the speed reducing gear 17 and a winding gear 23 of a winding shaft 22 fixedly provided at at least one side thereof. When the speed reducing gear 17 rotates, the winding shaft 22 synchronously rotates therewith, and a winding disk shaft located externally of the machine housing and fixedly mounted at the winding shaft 22 is also rotates therewith.

In addition, in order to prevent wear and loosening, the toothed belt 21 may be provided with an idle wheel 24 therein. The idle wheel 24 is adjustable so that it may exert a pressure on the toothed belt 21 to adjust the tautness thereof.

The direction change device 3 includes a lower pulley 31 pivotally connected to the speed reducing shaft 16, an upper pulley 33, and a direction change belt 32 disposed between the lower and upper pulleys 31, 33 and fitted around the respective pulleys 31, 33. When the upper pulley 33 rotates, a center shaft 34 may be rotated thereby, causing the reciprocating device 4 to synchronously rotate therewith.

Figure 3:
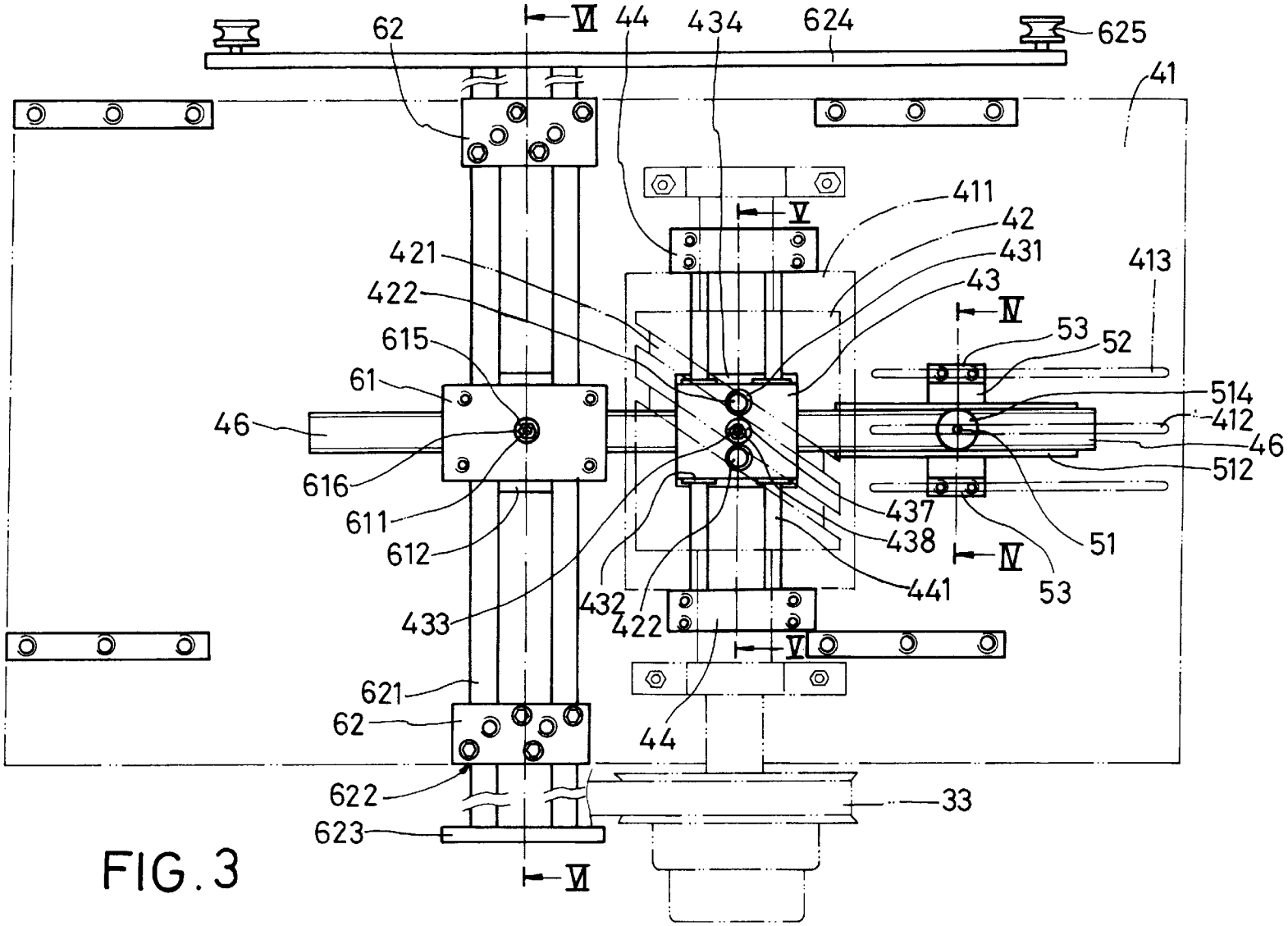
FIG. 3 is a top view of the present invention after removal of the machine plate.
Figure 5:
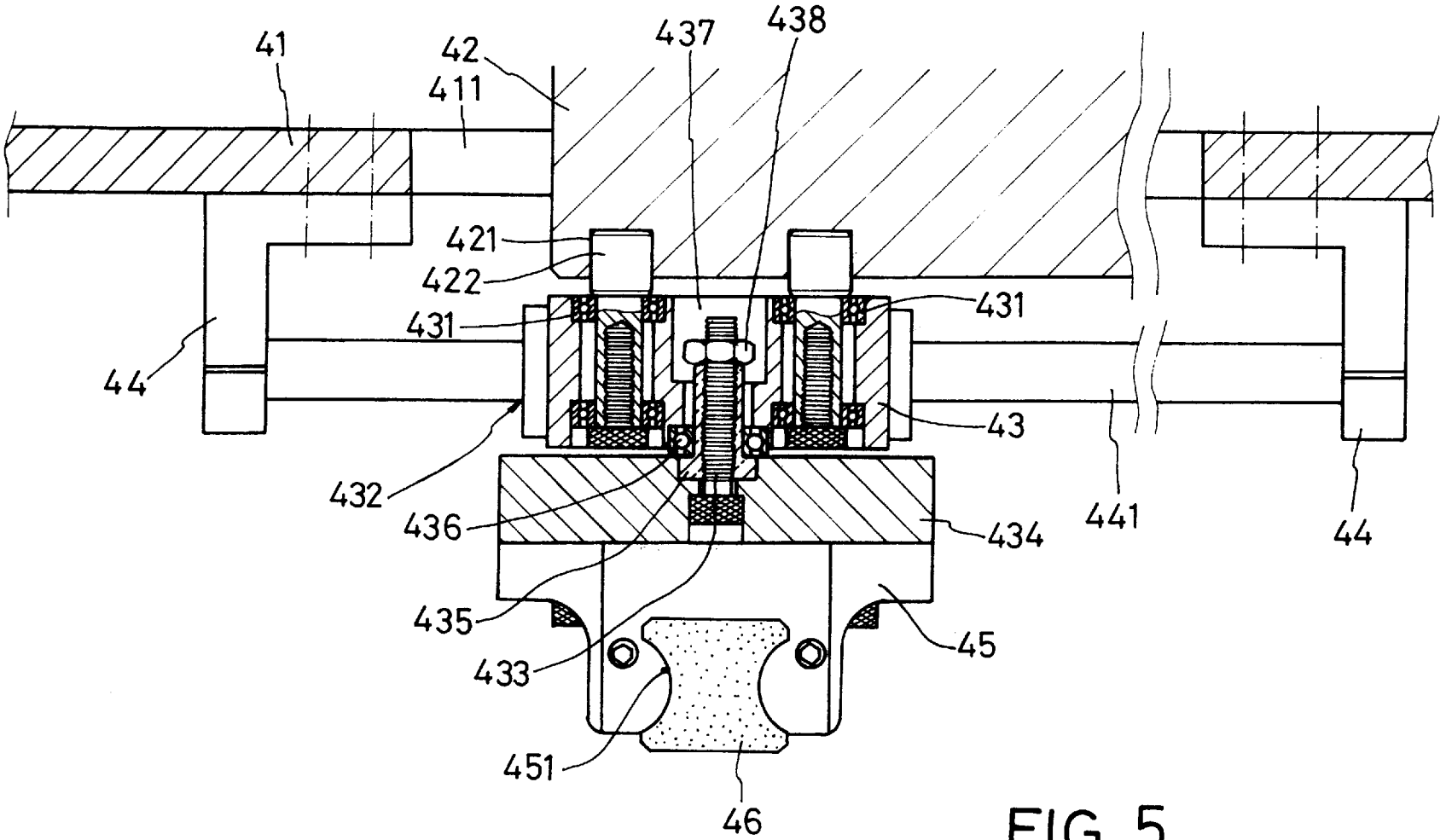
FIG. 5 is a sectional view taken along line V—V of FIG. 3.

Referring to FIGS. 1, 3, and 5, which illustrate the reciprocating device 4, the reciprocating device 4 includes a machine plate 41 with a groove 411 accommodating a rotary wheel 42 connected to the center shaft 34. A peripheral surface of the rotary wheel 42 is provided with one or more curved slide grooves 421 connected end to end. The rotary wheel 42 is connected to respective slide posts 422. The slide posts are locked to an upper side of a slide seat 43 with one or more bearings 431 disposed therein. In addition, both sides of the slide seat 43 are each provided with a through hole 432 in which the bearing 431 is held, for passage of a fixed track 441 disposed between two securing plates 44 fixedly provided at both sides of the machine plate 11, so that the slide seat 43 may slide along the fixed track 441. In addition, a drive screw rod 433 is passed through a connecting seat 434 and is then connected to a sleeve 435 in the shape of an inverted T. A bottom of the sleeve 435 is coupled to a bearing 436 and are together placed in a seat hole 437 at the center of the slide seat 43. In order that a swing rod 46 at the bottom of the slide seat 43 may swing back and forth when the slide seat 43 reciprocates, a guide track seat 45 is connected to a lower side of the connecting seat 434. The guide track seat 45 has a track 451 with a section corresponding to that of the swing rod 46 so that, after they are coupled, the swing rod 46 may synchronously reciprocate with the slide seat 43.

When the rotary wheel 42 is brought by the transmission device 1 and direction change device 3 to rotate, the curved slide grooves 421 will be in a rotational state, forming curved paths. The slide posts 422 inserted in the curved slide grooves 421 will displace back and forth along the paths. Since the slide posts 422 are connected to the slide seat 43, the slide seat 43 will also displace back and forth along the paths. Since the connecting seat 434 and the guide track seat 45 are subjected to the swing rod 46 so that they cannot "normally" displace back and forth and can only use the sleeve 435 as their pivot. And since there is the bearing 436 between the sleeve 435 and the slide seat 43, there is alteration in angle during displacement of the connecting seat 434 and the guide track seat 45. However they remain perpendicular to the swing rod 46 (see FIG. 7).

Figure 4:
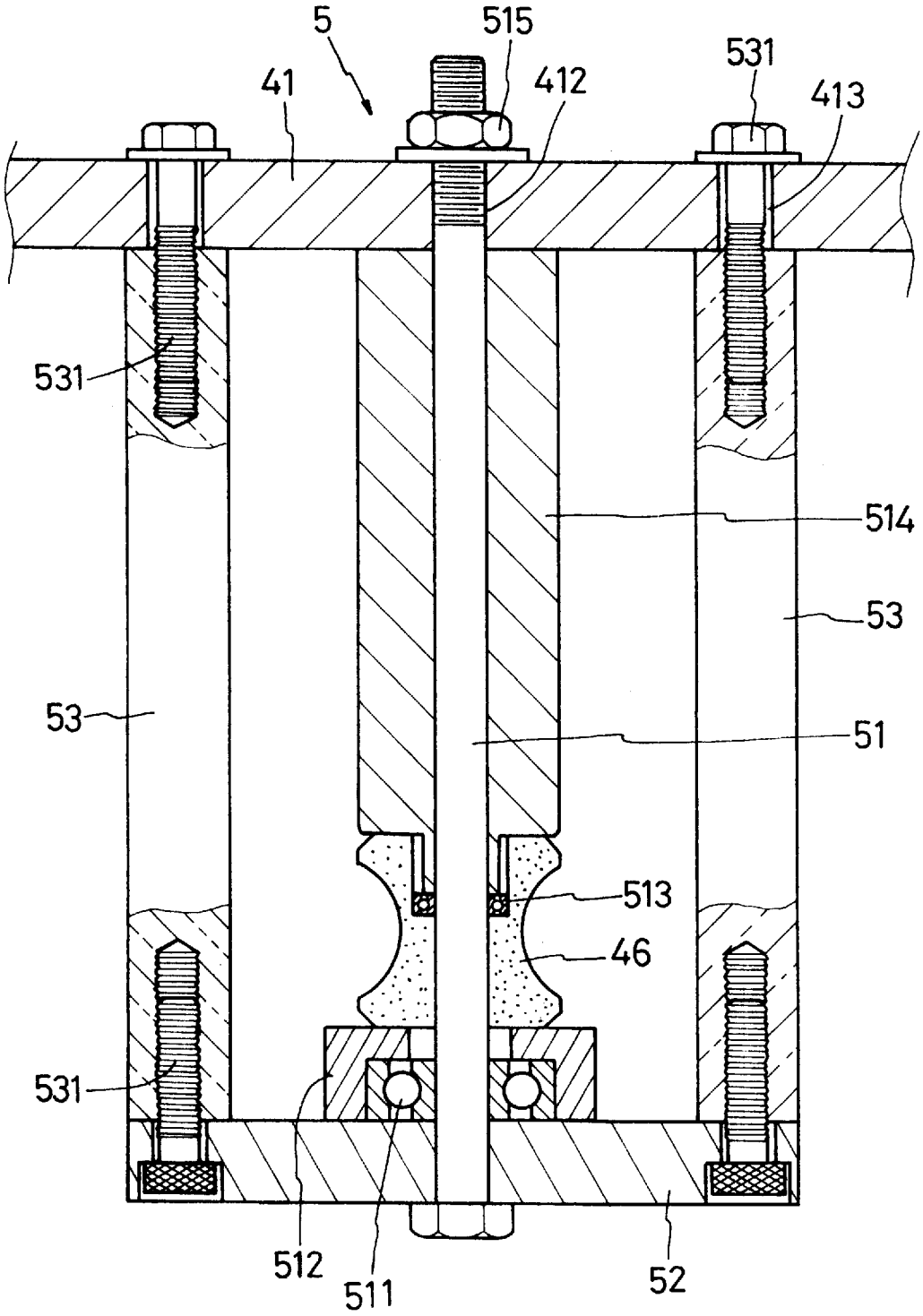
FIG. 4 is a sectional view taken along line IV—IV of FIG. 3.

With reference to FIGS. 1, 3 and 4 illustrating the support device 5, the support device 5 includes a main rod 51 passing through a bottom plate 52, a bearing 511, a bearing seat 512, the swing rod 46, a bearing 513, and a packing sleeve 514. After the main rod 51 has passed through a plate groove 412 of the machine plate 41, a nut 515 is used to lock the main rod 51 to the machine plate 41. At both sides of the main rod 51 are provided with respective auxiliary plates 53. Each auxiliary plate 53 has a lower end locked to the bottom plate 52 by screws 531. Screws 531 are also passed through an upper end of each auxiliary plate 53 and through auxiliary grooves 413 at both sides of the plate groove 412, so that each auxiliary plate 53 relative to the main rod 51 is a U-shaped structure. When the user loosens the screws 531 and nuts 515 at the upper ends, the auxiliary plates 53 and the main rod 51 may be caused to displace left and right respectively in the auxiliary grooves 413 and the plate groove 412. For instance, when the adjustment is leftwise the swing rod 46 will swing through a smaller angle. On the contrary, if the adjustment is rightwise, the swing rod 46 will swing through a large angle.

When the support device 5 is active, the main rod 51, bottom plate 52, auxiliary plates 53 and the packing sleeve 514 are all stationary, while the swing rod 46 and the bearing seat 512 swing through a sector with the main rod 51 as the center. Since there are bearings 511 and 513 disposed among the main rod 52 and the swing rod 46 and the bearing seat 512, the swinging movement may be smooth.

Figure 6:
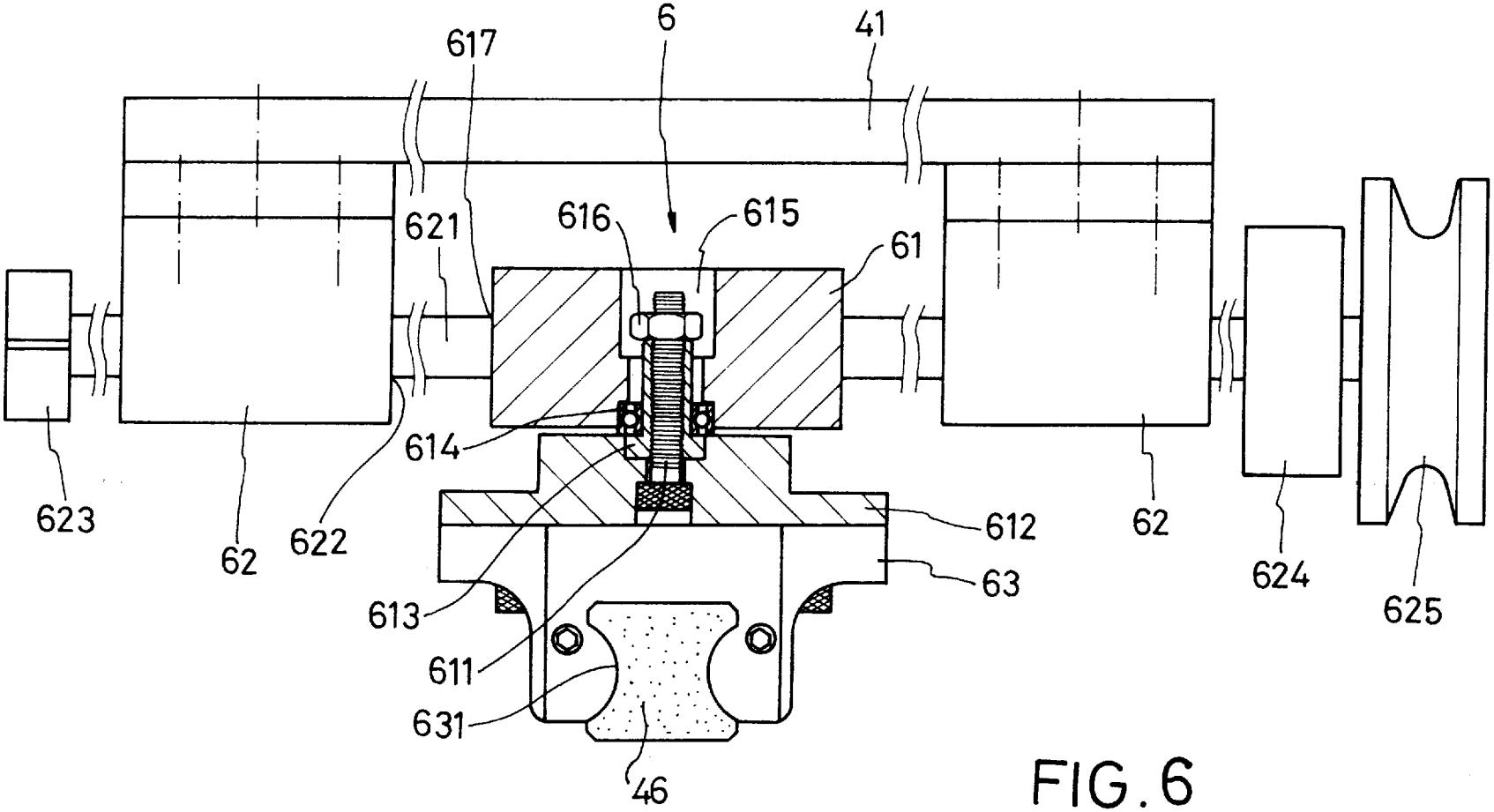
FIG. 6 is a sectional view taken along line VI—VI of FIG. 3.

With reference to FIGS. 1, 3 and 6, which are schematic views of the driven device 6, the driven device 6 includes a slide block 61. A driven screw rod 611 extends from a bottom side of the slide block 61 and passes through a pivot seat 612 to connect with an inverted T-shaped shaft sleeve 613. Then the shaft sleeve 613 is coupled to a bearing 614 and are together placed in a block hole 615 at the center of a slide block 61. Next a nut 616 is locked with the driven screw rod 611 so that the slide block 61 and the pivot seat 612 achieve linking-up movement. In addition, both sides of the slide block 61 are respectively provided with a connecting track hole 617 for passage of a movable track 621 disposed between respective securing frames 62 fixed at both sides of the machine plate 41. The slide block 61 is locked to the movable track 621 by screws so that it may bring the movable track 621 to displace back and forth. The movable track 621 has two ends each of which passes through a frame hole 622 of each securing frame 62. The frame hole 622 contains a bearing therein to ensure smooth displacement of the movable track 62. In addition, in order to pose a limit for the back and forth displacement of the movable track 621 so as to prevent its ends from extending inside the securing frames 62, a stop ring 623 is locked at a rear end of the movable track 621, while a front end is connected to an elongated wire arranging bar 624. Two wire arranging wheels 625 are respectively provided at both sides of the wire arranging bar 624 for facilitating positioning of the wire and displacement with the movable track 621. Furthermore, in order that the whole driven device 6 may move with the swing rod 46, a swing track seat 63 is disposed below the pivot seat 612, with a seat groove 631 of a cross-section identical to that of the swing rod 46 formed at a bottom side thereof, so that the whole driven device 6 may displace back and forth with the swinging movement of the swing rod 46 when the swing rod 46 is fitted into the swing track seat 63.

Figure 7:
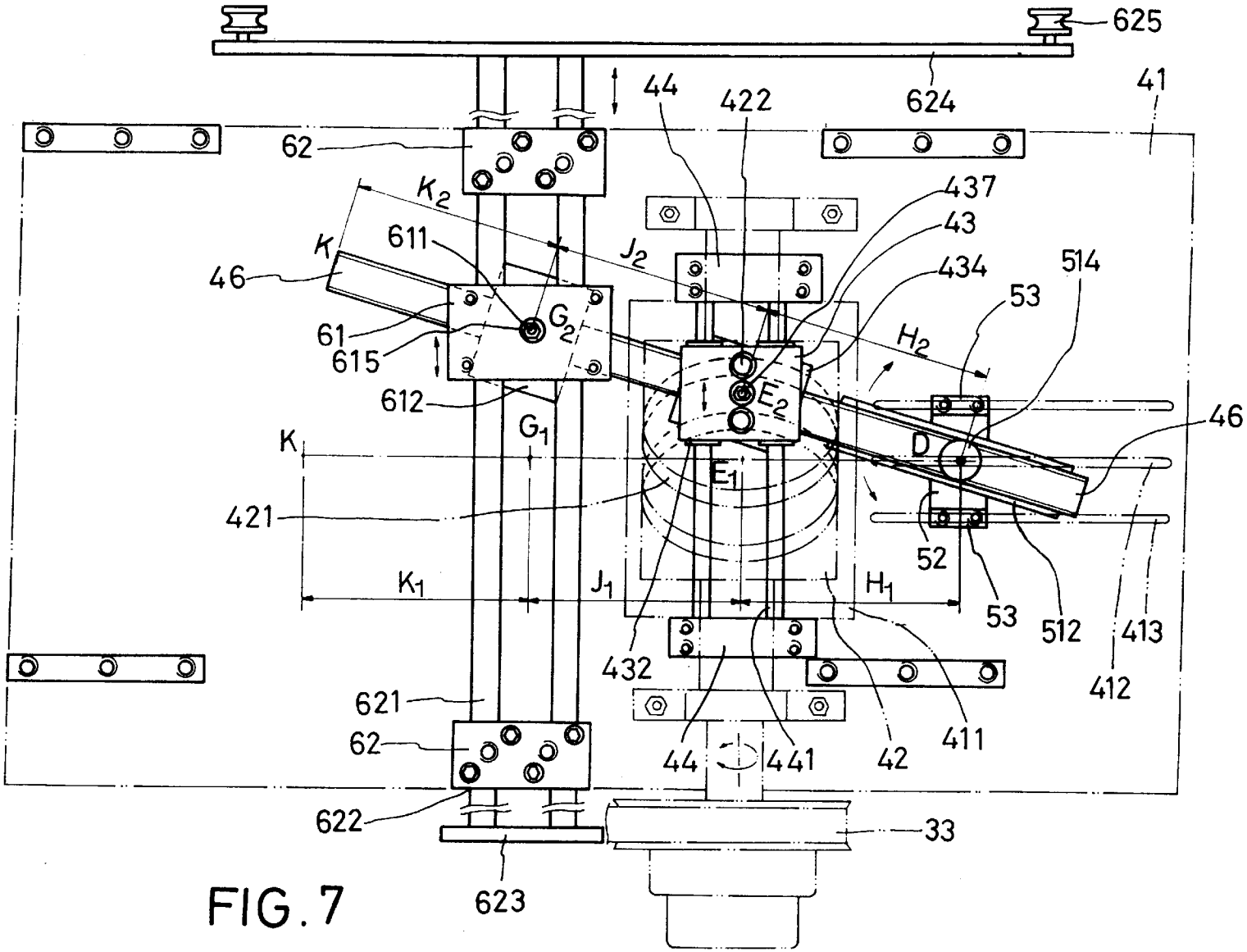
FIG. 7 is a schematic view of the operation of the present invention.

As a matter of fact, the motion of the driven device 6 is similar to that of the reciprocating device 4. For instance, when the swing rod 46 swings about a sector, the pivot seat 612 and the swing track seat 63 will have a change in angle, but they remain perpendicular to the swing rod 46 (as shown in FIG. 7), so that the slide block 61 displaces back and forth, causing the stop ring 623, movable rod 621, wire arranging bar 624 and the wire arranging wheels 625 to displace synchronously therewith. The difference between the two devices 4, 6 is that the slide seat 43 slides along the fixed track 441 while the slide block 61 brings the movable track 621 to displace therewith.

With further reference to FIGS. 1–7, during operation, when the motor 11 is started, the output power is reduced by the speed reducer 15. One end of the speed reducing shaft 16 will rotate the winding device 2, while the other end thereof rotates the rotary wheel 42 through the direction change of the direction change device 3 and rotation of the center shaft 34. The slide posts 422 displaces back and forth along the path of curved slide grooves 421. At this point, the connecting seat 434 and the guide track seat 45 urge the swing rod 46 to swing through a sector with the main rod 51 of the support device 5 as its pivot, so that the pivot seat 612 and the swing track seat 63 at the bottom of the driven device 6 may be restricted by the swing rod 46 to perform a sector-like movement of a larger degree, and forcing the slide block 61 and the movable rod 621 to reciprocate. Relatively, the wire arranging bar 624 will reciprocate as well. At this point, the wire material in the wire arranging wheels 625 will be wound round the winding disk shaft.

Referring to FIG. 7, as a matter of fact, point D of the main rod 51 to point K at the rear end of the swing rod 46 is constant. Therefore, when the swing rod 46 swings about a sector, it is not the same as when it is in a level position. For instance, the main rod 51, drive screw rod 433, driven screw rod 611, and the rear end of the swing rod 46 are located at points D, $E_1$, $G_1$, and K when in a level position, with the respective distances of $H_1$, $J_1$, and $K_1$. When the swing rod 46 swings upwardly, the drive screw rod 433 and the driven screw rod 611 will change to positions $E_2$ and $G_2$, while the distances are $H_2$, $J_2$ and $K_2$, with distance ratios of $H_2>H_1$, $J_2>J_1$, and $K_2<K_1$.

Referring further to FIGS. 1 and 2, one side of the upper pulley 33 of the direction change device 3 may be coupled to a speed adjusting device 35 of the speed change device. When the user turns the speed adjusting device 35, the distance between a left wing 331 and a right wing 332 obliquely and respectively disposed at both inner walls of the upper pulley 33 may be adjusted so as to achieve adjustment of the cyclic speed ratio of the upper pulley 33, further changing the displacement generated by the reciprocating device 4 driven by the rotary wheel 42, so that the wire is wound orderly in an alternate pattern on the winding disk shaft.

Since the rotary wheel 42 in the present invention keeps on rotating during operation, there is no need to employ a positive-reverse screw rod to achieve winding. Besides, due to the moment of force of the reciprocating device 4, support device 5, and driven device 6, the wound wire is in an alternate pattern so that wire entanglement during wire pulling is prevented.

Although the present invention has been illustrated and described with reference to the preferred embodiment thereof, it should be understood that it is in no way limited to the details of such embodiment but is capable of numerous modifications within the scope of the appended claims.

What is claimed is:

1. A double track wire arranging device for winding machines, said wire arranging device comprising:

a transmission device, having a motor with an output wheel engaging at least one output belt, said at least one output belt being further coupled to a speed reducer, one end of a speed reducing shaft extending from said speed reducer being connected to a speed reducing gear;

a winding device, comprising a toothed belt engaging said speed reducing gear, and a winding gear fixedly provided on a winding shaft, said toothed belt engaging said winding gear, so that said winding shaft synchronously rotates a winding disk shaft;

a direction change device, having an upper pulley and a lower pulley, a direction change belt disposed between said upper pulley and said lower pulley, and a center shaft extending from one side of said upper pulley, said lower pulley connected to said speed reducing shaft, and said upper pulley rotatable with said center shaft so as to rotate therewith, said direction change device being pivotally connected to another end of said speed reducing shaft;

a reciprocating device, having a rotary wheel provided on a machine plate, said rotary wheel being rotated by said center shaft, at least one curved slide groove being provided on said rotary wheel and engaged with a slide post disposed such that a slide post is moved below said machine plate back and forth as said rotary wheel rotates, a slide seat connected to said slide post so as to reciprocate along a fixed track disposed between two securing plates below said machine plate so as to move a connecting seat and a guide track seat, connected to said slide seat back and forth, wherein said guide track seat is connected to a swing rod, said swing rod being capable of swinging movement;

a support device, having a main rod passing through a base plate, said swing rod, a packing sleeve and a plate groove of said machine plate and being locked to said machine plate by nuts, two bearings being respectively disposed at an upper portion and a lower portion between said swing rod and said main rod, such that said swing rod swings about said main rod as a pivot;

a driven device, having a slide block, said slide block being coupled to a movable track disposed between two securing frames below said machine plate so that said slide block and said movable track may synchronously move, a lower portion of said slide block being connected to a pivot seat and a swing track seat, said swing track seat being connected to said swing rod such that when said swing rod swings, said pivot seat, said slide block, and said movable track will be displaced back and forth so that wire arranging wheels on a wire arranging shaft at a front end of said movable track will reciprocate to enable wire to wind round said winding disk shaft in an alternative manner.

2. A double track type wire arranging device for winding machines as claimed in claim 1, wherein said upper pulley further comprises a speed adjusting device disposed at one side thereof and coupled to said center shaft, for adjusting a cyclic speed ratio of said upper pulley.

3. A double track type arranging device for winding machines as claimed in claim 1, further comprising a connecting seat pivotally connected to said slide seat and to said swing rod.

4. A double track type wire arranging device for winding machines as claimed in claim 1, further comprising auxiliary plates on either side of said main rod of said support device extending between said machine plate and said base plate so as to form a U-shaped frame, said machine plate being provided with a plate groove and two auxiliary grooves corresponding to said main rod and said auxiliary plates at both sides thereof, so that said main rod and said auxiliary plates are displaceable in said plate groove and said auxiliary grooves.

5. A double track type wiring arranging device for winding machines as claimed in claim 1, further comprising a driven screw rod passing through said pivot seat and fitted with a shaft sleeve and locked in position by a nut on said driven screw rod.

* * * * *